US009709284B2

(12) United States Patent
Bach et al.

(10) Patent No.: US 9,709,284 B2
(45) Date of Patent: Jul. 18, 2017

(54) APPLIANCE USER INTERFACE

(71) Applicant: General Electric Company, Schenectady, NY (US)

(72) Inventors: James Carter Bach, Seymour, IN (US); Ashley Wayne Burt, Roswell, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 300 days.

(21) Appl. No.: 14/681,143

(22) Filed: Apr. 8, 2015

(65) Prior Publication Data

US 2016/0299595 A1 Oct. 13, 2016

(51) Int. Cl.
*F24C 7/08* (2006.01)

(52) U.S. Cl.
CPC ..... *F24C 7/086* (2013.01); *F24C 7/083* (2013.01)

(58) Field of Classification Search
CPC ..... F24C 7/086; F24C 7/083; F24C 7/082; F24C 7/081; F24C 7/08; H03K 17/962; H03K 17/9622; H03K 17/9627; H03K 17/9629; H03K 17/9631; H03K 17/9638; H03K 17/9602; H03K 17/9618; H03K 2217/96031; H03K 2217/96042; H03K 2217/96046; H03K 2217/9607; H03K 2217/96071; H03K 2217/960735; H03K 2217/960785; H03K 2217/96079; H03K 2217/9651; H03K 2217/9653; H03K 2217/9655; H03K 2217/9656
See application file for complete search history.

(56) References Cited

U.S. PATENT DOCUMENTS

| | | | | |
|---|---|---|---|---|
| 7,525,063 | B2 | 4/2009 | Dorwarth et al. | |
| 7,915,553 | B2 * | 3/2011 | Arione | H03K 17/962 200/314 |
| 2006/0187200 | A1 * | 8/2006 | Martin | G06F 3/0421 345/156 |
| 2009/0290358 | A1 * | 11/2009 | Nakamura | G06F 1/1616 362/311.01 |
| 2010/0176112 | A1 * | 7/2010 | Izutani | H05B 6/062 219/220 |
| 2011/0087987 | A1 | 4/2011 | Brown | |

FOREIGN PATENT DOCUMENTS

| | | |
|---|---|---|
| JP | 3826112 B2 | 9/2006 |

* cited by examiner

*Primary Examiner* — Shawntina Fuqua
(74) *Attorney, Agent, or Firm* — Dority & Manning, P.A.

(57) ABSTRACT

A user interface for an appliance is provided for displaying information about multiple operating states of a feature of the appliance within an area for selecting the operative state of the feature. More particularly, a portion of the user interface may be configured both to display a feature's current state and to allow a user to change the state of the feature in the same physical location. A cooktop appliance with features for displaying a selected size, heating element, and/or power density of a cooking zone of the cooktop appliance co-located within an area for selecting the size, heating element, and/or power density of the cooking zone also is provided.

18 Claims, 7 Drawing Sheets

APPLIANCE USER INTERFACE

FIELD OF THE INVENTION

The subject matter of the present disclosure relates generally to user interface assemblies for appliances, in particular cooktop appliances.

BACKGROUND OF THE INVENTION

Cooktop appliances typically can include a variety of configurations. As an example, cooktop appliances may use a glass and/or ceramic-glass cooking panel for supporting cooking utensils. For such cooktop appliances, the heating sources can include, e.g., radiant, induction, and gas on glass. A variety of controls can be provided for the heating sources such as, e.g., traditional rotatable knobs and/or electronic types that rely on sensitivity to a user's touch. These controls may be provided as part of a user interface assembly for controlling various operations of the cooktop appliance.

Such user interface assemblies may use a variety of lighted features, such as, e.g., text, digits, and/or symbols, to display information to a user of the cooktop appliance on the surface of the cooktop appliance. For example, the upper surface of the cooking panel may include a user interface area where the controls are located, as well as where information such as, e.g., whether a heating element is activated or at what heat level a heating element is set, may be displayed to the user using lighted text, digits, and/or symbols. Some user interface assemblies may use multiple controls and multiple lighted features to select various operative states or modes of the cooktop appliance, such as the size and/or power density of a variable size or multi-element cooking zone of the cooktop. However, to improve the appearance of and/or reduce the space required for the user interface, it may be desirable to provide a control, such as a capacitive touch control button, whereby multiple states can be selected and information about the multiple states can be displayed, e.g., using multiple illuminated graphics or images.

Accordingly, a user interface for an appliance with features for displaying information about multiple operating states of the appliance within an area for selecting an operative state would be beneficial. A cooktop appliance with features for displaying a selected size, heating element, and/or power density of a cooking zone of the cooktop appliance within an area for selecting the size, heating element, and/or power density of the cooking zone would also be useful.

BRIEF DESCRIPTION OF THE INVENTION

The present invention provides a user interface for an appliance with features for displaying information about multiple operating states of the appliance within an area for selecting an operative state. A cooktop appliance with features for displaying a selected size, heating element, and/or power density of a cooking zone of the cooktop appliance within an area for selecting the size, heating element, and/or power density of the cooking zone also is provided. Additional aspects and advantages of the invention will be set forth in part in the following description, may be apparent from the description, or may be learned through practice of the invention.

In a first exemplary embodiment, a user interface assembly for an appliance is provided. The user interface assembly includes a panel having a user interface and a selection portion within the user interface. The user interface assembly also includes a first printed circuit board spaced apart from the panel. The first printed circuit board comprises a plurality of light sources. The user interface assembly further includes a second printed circuit board disposed between the panel and the first printed circuit board, the second printed circuit board comprising one or more apertures for the passage of light therethrough and a capacitive touch sensing system for sensing touch inputs by a user of the user interface assembly. The user interface assembly also includes a light guide positioned between the first printed circuit board and the second printed circuit board adjacent the selection portion. The light guide surrounds one or more light sources such that the light guide directs substantially all light from the one or more light sources to the user interface to display a graphic with multiple images within the selection portion.

In a second exemplary embodiment, a cooktop appliance is provided. The cooktop appliance includes a cooking panel comprising a cooking zone; a plurality of heating elements positioned adjacent the cooking zone for heating the cooking zone; and a user interface assembly. The user interface assembly includes a user interface defined on the cooking panel and including a selection portion configured to display a graphic; a first printed circuit board spaced apart from the cooking panel and comprising a plurality of light sources; and a second printed circuit board disposed between the cooking panel and the first printed circuit board. The second printed circuit board comprises one or more apertures for the passage of light therethrough, at least one aperture defined adjacent the selection portion, and a capacitive touch sensing system for sensing touch inputs by a user of the user interface. The capacitive touch sensing system is in operative communication with the heating elements and the light sources. The user interface also includes a light guide positioned between the first printed circuit board and the second printed circuit board adjacent the selection portion. The light guide surrounds one or more light sources such that the light guide directs substantially all light from the light source to the user interface to display a graphic with multiple images within the selection portion.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same reference numerals in different figures denotes the same or similar features.

DETAILED DESCRIPTION OF THE INVENTION

Figure 1:
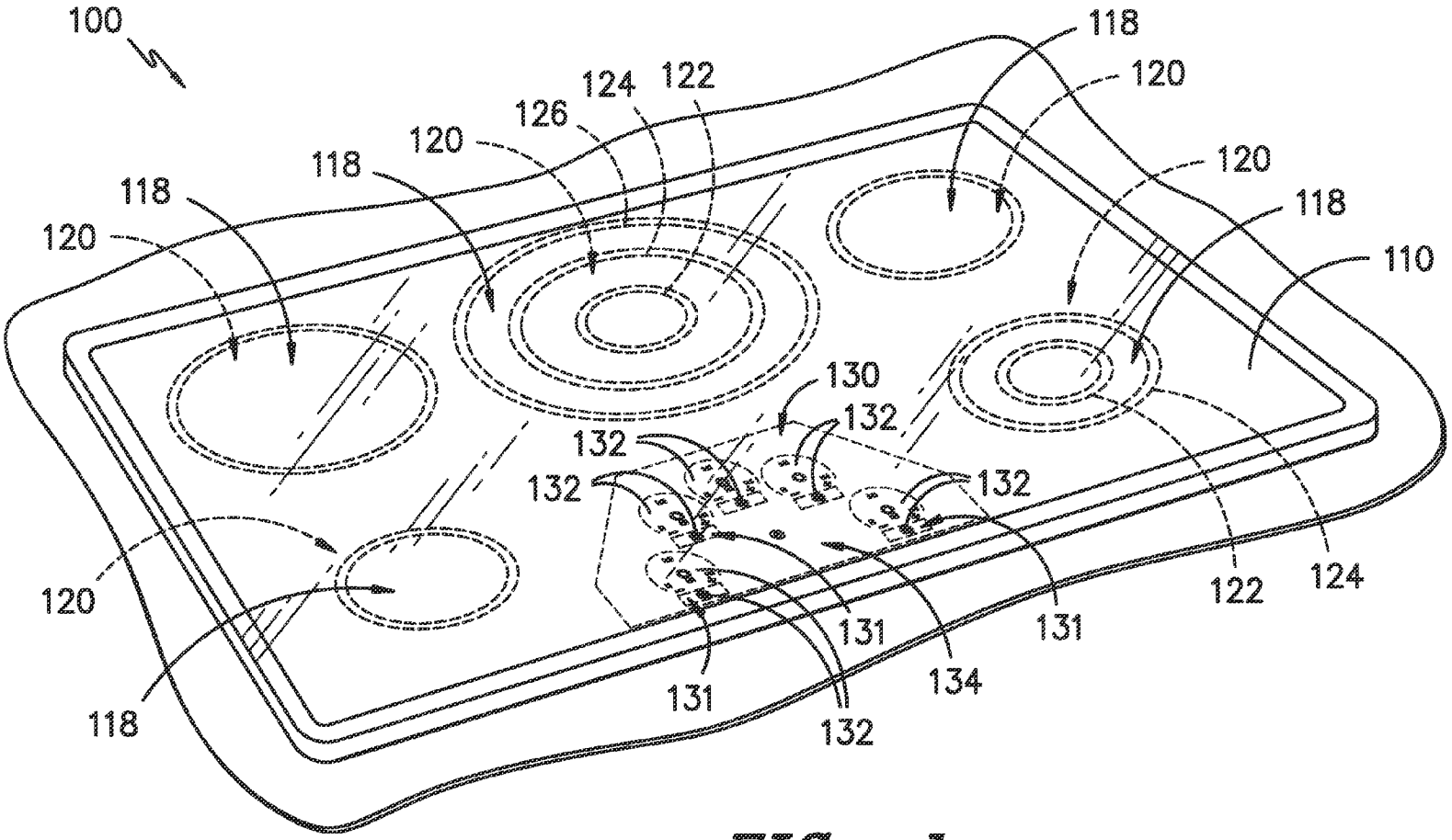
FIG. 1 provides a top perspective view of an exemplary embodiment of a cooktop appliance of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a top, perspective view of a cooktop appliance 100 according to an exemplary embodiment of the present subject matter. Cooktop appliance 100 can be installed in various locations such as in cabinetry in a kitchen, with one or more ovens to form a range appliance, or as a standalone appliance. Thus, as used herein, the term "cooktop appliance" includes grill appliances, stove appliances, range appliances, and other appliances that incorporate cooktops, which are generally known as surface cooking appliances.

Cooktop appliance 100 includes a cooking panel 110 for supporting thereon cooking utensils such as pots or pans. Cooking panel 110 is a generally transparent material that may be constructed from, e.g., glass, ceramics, and/or combinations thereof.

Cooking panel 110 may include one or more cooking zones 118. As shown in FIG. 1, cooking zones 118 may be generally circular in shape and may have various diameters. For example, each cooking zone 118 can have a different diameter, the same diameter, or any suitable combination thereof. In other embodiments, cooking zones 118 may be generally rectangular in shape, and each cooking zone 118 may have the same length and width, a different length and width, or any suitable combination thereof. In still other embodiments, cooking zones 118 may have any suitable shape and size, and in some embodiments, cooking panel 110 may include cooking zones 118 of various shapes and sizes, e.g., a combination of circular and rectangular cooking zones 118. Further, while shown with five cooking zones 118 in the exemplary embodiment of FIG. 1, in alternative exemplary embodiments, cooktop appliance 100 may include any number of cooking zones 118.

A heating assembly 120 is mounted below cooking panel 110 adjacent each cooking zone 118 such that heating assemblies 120 are positioned below cooking panel 110, e.g., along a vertical direction V. Each heating assembly 120 may comprise a single heating element or a plurality of heating elements or sub-elements, such as a first heating element 122, a second heating element 124, and/or a third heating element 126 as shown in FIG. 1, with each heating element or sub-element contributing to the power density of the respective cooking zone 118. For each heating assembly having more than one heating element, heating elements 122, 124, and/or 126 may be activated individually or in conjunction with one or both of the other heating elements 122, 124, 126. For example, for a given heating assembly 120, first heating element 122 may be activated individually, with second heating element 124, with third heating element 126, or with both second heating element 124 and third heating element 126. As an additional example, for a heating assembly 120 comprising two heating elements, such as first heating element 122 and second heating element 124, both heating elements 122, 124 may be activated individually or simultaneously. Thus, using heating assemblies 120 having multiple heating elements, cooking zones 118 may vary in size and/or power density.

Cooktop appliance 100 is provided by way of example only and is not limited to the exemplary embodiment shown in FIG. 1. For example, a cooktop appliance having one or more heating assemblies in combination with one or more electric or gas burner heating elements can be provided. In addition, various combinations of number of heating assemblies, position of heating assemblies, and/or size of heating assemblies can be provided. Moreover, heating assemblies 120 can have a variety of constructions for the input of energy in the form of heat to the cooking utensils. For example, heating assemblies 120 can be constructed as electric radiant or gas-on-glass heating sources. Mechanisms associated with each such type of heating source are positioned under cooking panel 110 adjacent cooking zones 118 and will be well understood of one of skill in the art using the teachings disclosed herein.

A user interface 130 provides visual information to a user and allows a user to select various options for the operation of cooktop appliance 100. For example, user interface 130 may include a selection portion 131 for each cooking zone 118, and within selection portion 131, a user may select which heating element or elements of the associated heating assembly 120 the user desires to be activated and information may be displayed to the user such as, e.g., which heating element or elements is active and/or at what size or power density has been selected for cooking zone 118. More particularly, as shown in the exemplary embodiment of FIG. 1, user interface 130 includes one or more capacitive touch input components 132, which can be used as part of a capacitive touch sensing system 171 (FIG. 2) to allow for the selective activation, adjustment, or control of any or all heating assemblies 120. Touch input components 132 may also be provided for the selective activation, adjustment, or control of any timer features or other user adjustable inputs. One or more of a variety of electrical, mechanical or electro-mechanical input devices including rotary dials, push buttons, toggle/rocker switches, and/or touch pads can also be used singularly or in combination with touch input components 132. User interface 130 also includes a display component 134, such as a digital or analog display device designed to provide operational feedback to a user. Selection portion 131 of user interface 130 is further described below.

User interface 130 can be any type of input device and can have any configuration. In FIG. 1, user interface 130 is located within a portion of cooking panel 110. Alternatively, user interface 130 can be positioned on a vertical surface near a front side of cooktop appliance 100 or anywhere convenient for a user to access during operation of cooktop appliance 100. In some embodiments, cooktop appliance 100 may be a range cooktop, and in such embodiments, user interface 130 may be positioned on, e.g., a backsplash of the range.

Also, although described with respect to cooktop appliance 100, it should be readily understood that user interface 130 as described herein could be used with any suitable appliance. When used with other appliances, such as, e.g., washing machine appliances, dryer appliances, and/or refrigerator appliances, panel 110 may be constructed of glass, ceramics, plastics, and/or combinations thereof. Suitable plastic materials may include acrylics, polyethylene terephthalate ("PET"), or the like. In some embodiments, user interface 130 may be incorporated into or may form the control panel of an appliance; for example, user interface 130 may be incorporated into a backsplash of a washing machine or dryer appliance.

Operation of cooktop appliance 100 can be regulated by a controller (not shown) that is operatively coupled, i.e., in communication with, user interface 130 and heating assemblies 120, including first heating elements 122, second heating elements 124, and third heating elements 126. For example, in response to user manipulation of a touch input component 132, the controller operates one or more of heating assemblies 120, e.g., by operating one or more of heating elements 122, 124, 126. The controller is also provided with other features. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout cooktop appliance 100. In the illustrated embodiment, the controller may be located under or next to the user interface 130. In such an embodiment, input/output ("I/O") signals are routed between the controller and various operational components of appliance 100 such heating assemblies 120, touch input components 132, sensors, graphical displays, and/or one or more alarms. In one embodiment, the user interface 130 may represent a general purpose I/O ("GPIO") device or functional block. User interface 130 may be in communication with the controller via one or more signal lines or shared communication busses.

Figure 2:
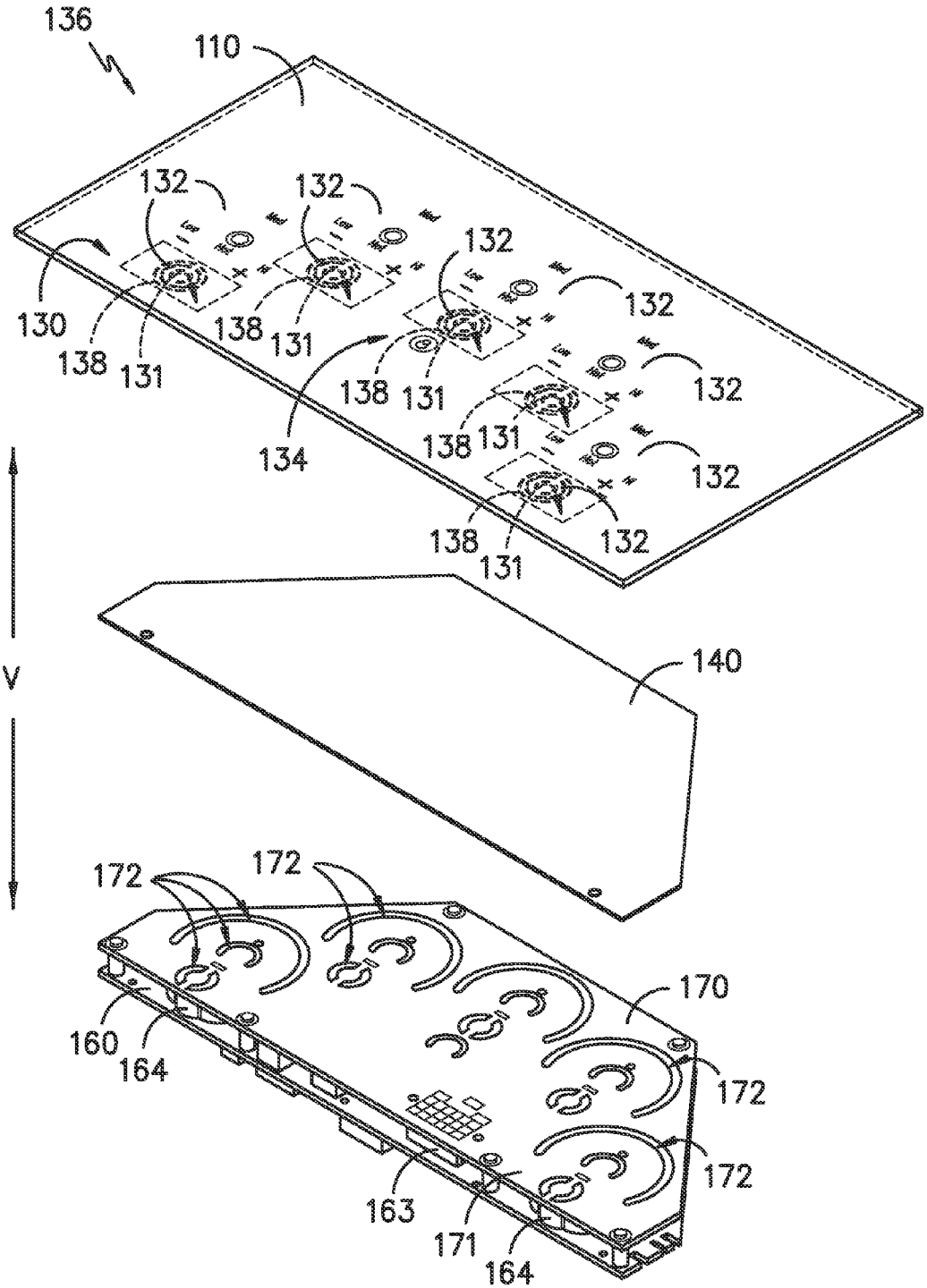
FIG. 2 provides an exploded view of an exemplary embodiment of a user interface assembly of the present subject matter.

FIG. 2 illustrates an exploded view of a user interface assembly 136 of cooktop 100. As shown, a user of cooktop appliance 100 may input and receive information regarding the operation of cooktop 100 at user interface 130, which is a portion of cooking panel 110. A variety of text, digits, and/or symbols may be printed on user interface 130 to indicate, e.g., the operation of a cooking zone 118 or the area of user interface 130 to touch to input certain information. In alternative embodiments, no text, digits, or symbols may appear on user interface 130 unless cooktop 100 is in use.

As shown in FIG. 2, a first printed circuit board 160 is positioned below user interface 130 along the vertical direction V. First printed circuit board 160 may include a plurality of light sources 162 (FIG. 6) for illuminating user interface 130. Each light source 162 may be, e.g., a light emitting diode ("LED"), an incandescent lamp, or any other appropriate light source. First printed circuit board 160 may also include other features for controlling user interface 130 and/or cooktop appliance 100.

A second printed circuit board 170 may be positioned above first printed circuit board 160 but below user interface 130 along vertical direction V. Second printed circuit board 170 may include a capacitive touch sensing system 171, whereby cooktop 100 is controlled at least in part through touch inputs on user interface 130 by a user of cooktop 100, e.g., through capacitive touch input components 132. Second printed circuit board 170 may also include a plurality of apertures 172 for the passage of light from light sources 162 to user interface 130.

As further shown in FIG. 2, a light transmissive layer 140 may be disposed between user interface 130 and light source or sources 162. In some embodiments, light transmissive layer 140 is positioned between user interface 130 and second printed circuit board 170. In alternative embodiments, light transmissive layer 140 may be disposed between first printed circuit board 160 and second printed circuit board 170. In still other embodiments, light transmissive layer 140 may be omitted.

Figure 3:
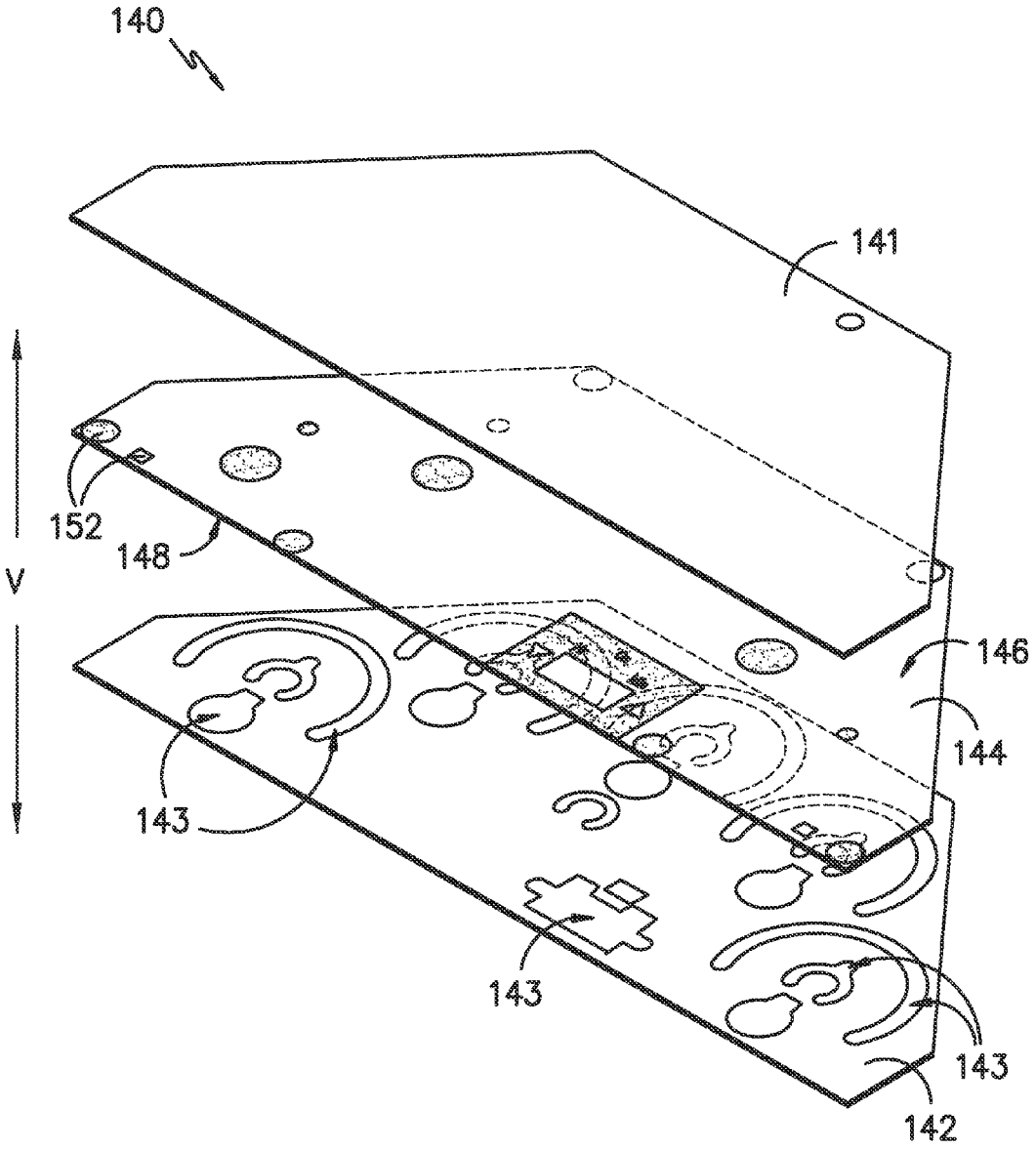
FIG. 3 provides an exploded view of an exemplary embodiment of a light transmissive layer of the present subject matter.

FIG. 3 illustrates an exploded view of light transmissive layer 140. In some embodiments, light transmissive layer 140 is a light diffusion layer, i.e., a diffuser, that diffuses the light from light sources 162 to provide uniform lighting of the illuminated text, digits, graphics, or other features on user interface 130. In such embodiments, light transmissive layer 140 may be, e.g., a frosted PET film. Alternatively or additionally, light transmissive layer 140 may be a graphics overlay, masking, or support layer that may be a clear layer of, e.g., a PET film for providing various graphics, such as graphic 138 described below, on user interface 130 by passing light through layer 140. Using a masking material 152 applied to light transmissive layer 140, text, digits, and/or symbols may be formed such that the text, digits, and/or symbols are presented to the user of cooktop 100 when illuminated by light source 162. Alternatively or additionally, masking material 152 may be used to mask various features of the construction of user interface assembly 136, e.g., circuit board pads, part labels, etc., such that the features are not visible to a user of cooktop 100. Masking material 152 may be, e.g., a black ink or the like.

Light transmissive layer 140 may include a support substrate 144. As illustrated in the exemplary embodiment of FIG. 3, support substrate 144 has a first surface 146 and a second surface 148. First surface 146 faces cooking panel 110 and second surface 148 faces light sources 162. In embodiments where light transmissive layer 140 is a light diffusion layer or diffuser, support substrate 144 may be a diffusive support substrate that diffuses light passing through the substrate. Support substrate 144 may have other configurations as well.

As described, masking material 152 may be used to define various features of user interface 130 or to mask various features of user interface assembly 136. Masking material 152 may be applied to first surface 146 of support substrate 144 or second surface 148 of support substrate 144. In alternative embodiments, masking material 152 may be applied to both first and second surfaces 146, 148. In still other embodiments, masking material 152 may be omitted.

In addition, an adhesive 141, such as, e.g., a transfer tape, may be used to bond first surface 146 of support substrate 144 to cooking panel 110, and an adhesive 142 may be used to bond second surface 148 to second printed circuit board 170. As described, in alternative embodiments, light transmissive layer 140 may be disposed between first printed circuit board 160 and second printed circuit board 170; in such embodiments, second circuit board 170 may be bonded directly to the cooking panel 110, and light transmissive layer 140 may be secured in place by alignment pins (not shown) such that a layer of adhesive 141, 142 is not needed. Each layer of adhesive 141, 142 may be composed of the same adhesive material or may be composed of different adhesive materials, e.g., an appropriate adhesive may be selected for bonding support substrate 144 to cooking panel 110 and another appropriate adhesive may be selected for bonding support substrate 144 to second printed circuit board 170. Further, as illustrated in FIG. 3, adhesive 142 may be selectively applied such that there are one or more voids 143 in layer of adhesive 142. Additionally, support substrate 144 may include one or more voids 143. Voids 143 may, e.g., aid in the assembly of light transmissive layer 140, allow light from light sources 162 to pass unimpeded through a layer of adhesive 142, or result from efficient application of adhesive 142. As appropriate, layer of adhesive 141 also may define one or more voids 143.

Figure 4:
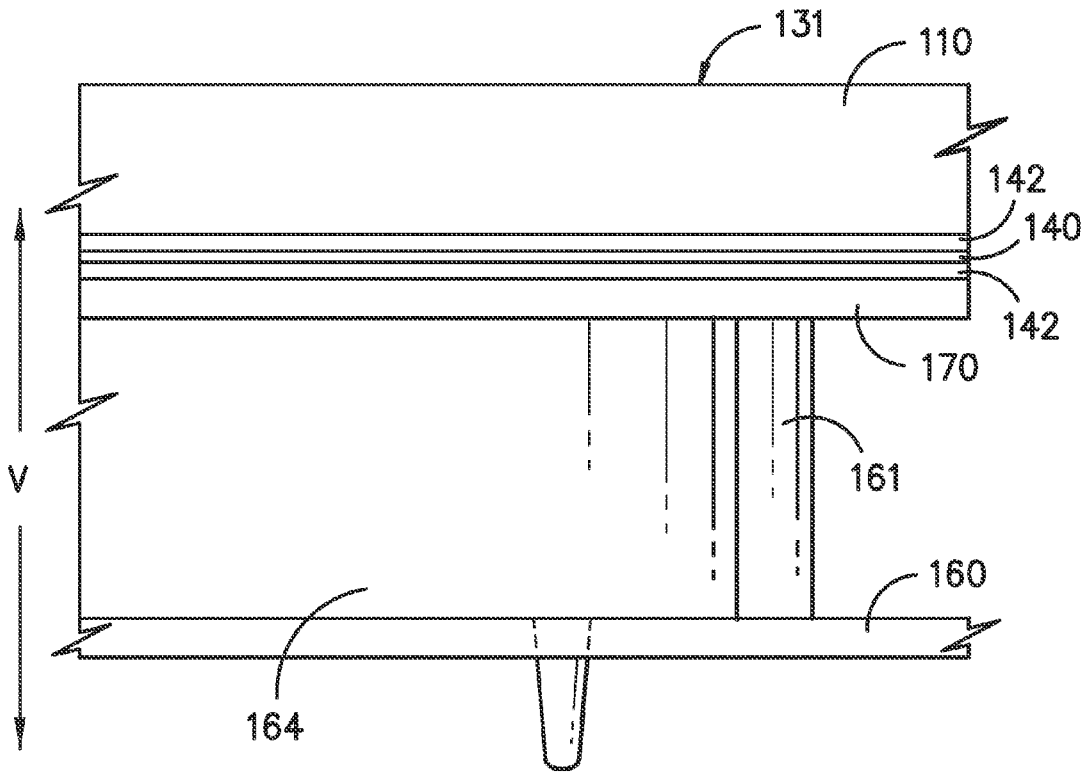
FIG. 4 provides a side view of the exemplary user interface assembly of FIG. 2.

As shown in FIG. 4, user interface assembly 136 may utilize one or more light guides 164 to guide light from light sources 162 toward user interface 130 located on cooking panel 110. In the embodiment shown in FIG. 4, light guide 164 is positioned along the vertical direction V between first printed circuit board 160 and second printed circuit board 170. Light guides 164 may be positioned in other locations as well. Further, light guides 164 may be of any suitable size and shape for guiding light toward user interface 130. Light guides 164 may be formed with air channels for guiding light toward user interface 130 or light guides 164 may comprise light pipes to convey light from light source 162 to user interface 130.

Figure 5:
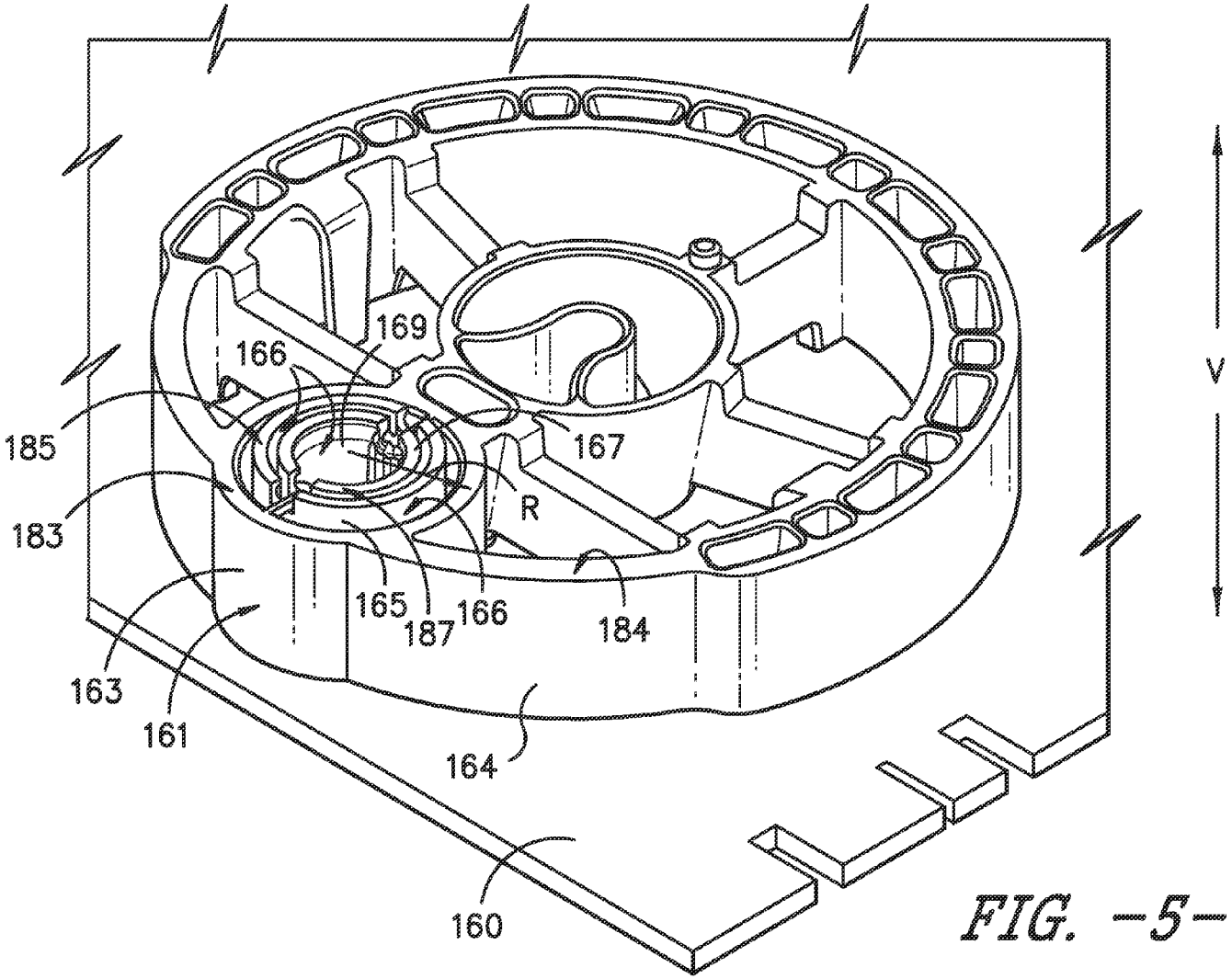
FIG. 5 provides a perspective view of an exemplary embodiment of a light guide of the present subject matter.
Figure 6:
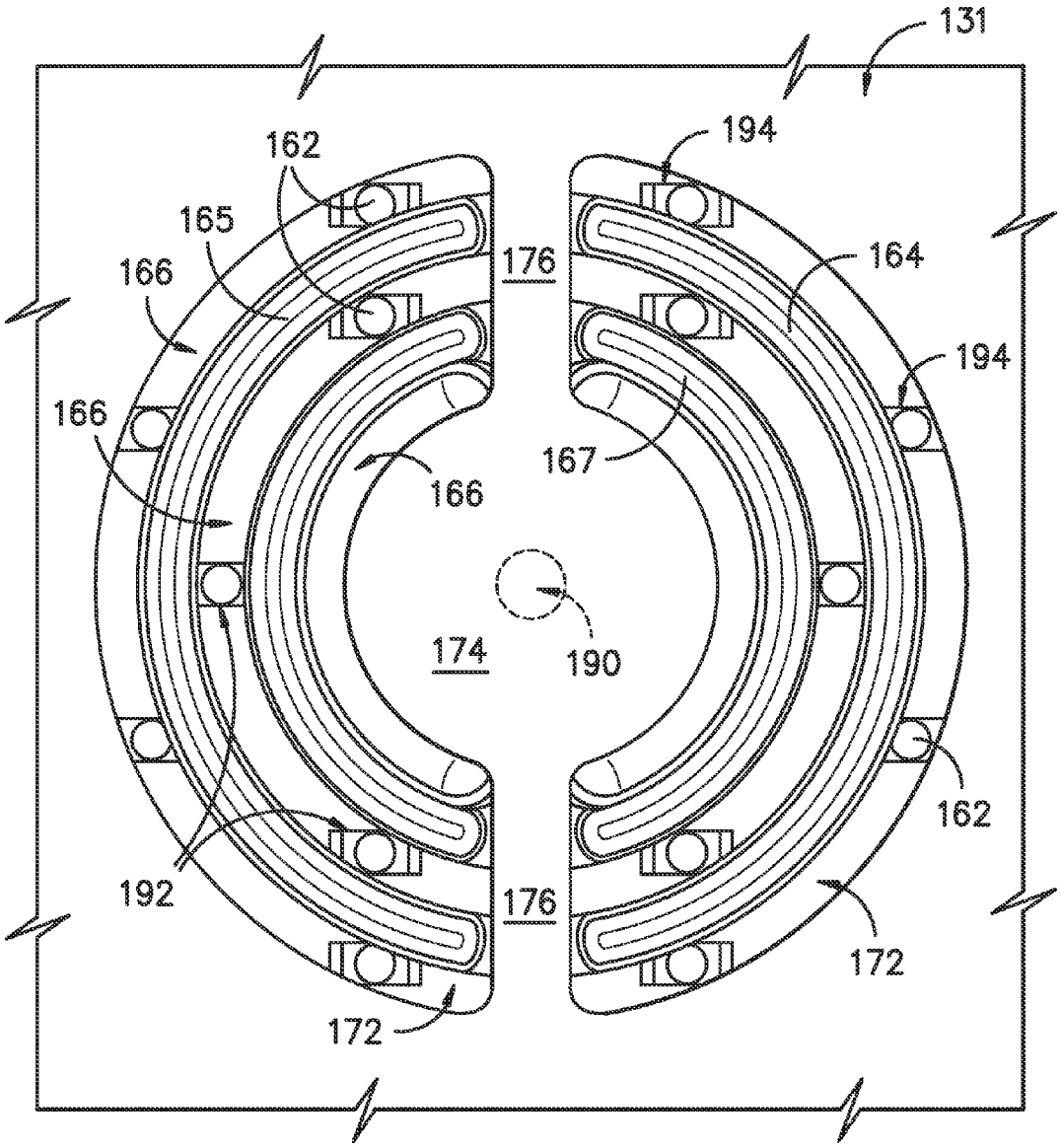
FIG. 6 provides a top view of an exemplary embodiment of a selection portion of a user interface of the present subject matter.

Referring now to FIGS. 5 and 6, in an exemplary embodiment, a light guide 164 is configured to guide light from one or more light sources 162 to user interface 130 to produce an illuminated graphic 138 with multiple images or sub-images within a selection portion 131. More specifically, light guide 164 includes a first portion 161 for guiding light to selection portion 131 of user interface 130, e.g., to indicate the heating elements or elements, size, or power density selected for a cooking zone 118. First portion 161 may include two or more nested geometric shapes to guide light to selection portion 131 to form graphic 138.

In the exemplary embodiment shown in FIGS. 5 and 6, the nested geometric shapes are concentric rings, such as an outer ring 163, an intermediate ring 165, and an inner ring 167. Intermediate ring 165 may be spaced apart from outer ring 163 along a radial direction R to delineate a generally ring-shaped passage 166 to guide light from light sources 162 to selection portion 131. Similarly, inner ring 167 may be spaced apart from intermediate ring 165 along radial direction R to define a generally ring-shaped passage 166 to guide light from light sources 162 to selection portion 131. Inner ring 167 may include a generally cylindrical-shaped inner surface 169 defining a passage 166 for light from one or more light sources 162 to selection portion 131 of user interface 130. In the illustrated embodiment, outer ring 163, intermediate ring 165, and inner ring 167 are concentric with one another. Further, intermediate ring 165 and inner ring 167 may be taller than outer ring 163 and the remainder of light guide 164; that is, a top surface 185 of intermediate ring 165 and a top surface 187 of inner ring 167 may be spaced apart from first printed circuit board 160 a greater distance along vertical direction V than a top surface 183 of outer ring 163 and a top surface 184 of the remainder of light guide 164. Top surfaces 185, 187 may be flush with or just below an uppermost surface of second printed circuit board 170 along vertical direction V; that is, top surfaces 185, 187 may protrude into apertures 172 but do not break the uppermost plane defined by second printed circuit board 170. First portion 161 and light guide 164 may have other shapes and configurations as well; for example, instead of concentric rings, first portion 161 may include other nested geometric shapes, such as, e.g., rectangles, hexagons, octagons, or any combination of geometric shapes.

As shown in FIG. 6, light guide 164 surrounds one or more light sources 162 positioned on first printed circuit board 160 to guide substantially all of the light from light sources 162 surrounded by light guide 164 to user interface 130. In particular, for the illustrated exemplary embodiment, a first group 190 of light sources 162 is positioned on first printed circuit board 160 such that first group 190 is surrounded or encircled by inner ring 167 of first portion 161. A second group 192 of light sources 162 is positioned on first printed circuit board 160 such that second group 192 is surrounded or encircled by intermediate ring 165 and inner ring 167 of first portion 161. A third group 194 of light sources 162 is positioned on first printed circuit board 160 such that third group 194 is surrounded or encircled by outer ring 163 and intermediate ring 165 of first portion 161.

Each group 190, 192, 194 may consist of one or more light sources 162, and any appropriate number and configuration of groups of light sources 162 may be used. As shown in FIG. 6, light sources 162 of second group 192 and third group 194 may be arranged on first printed circuit board 160 in a generally ring-shaped configuration, and first group 190 may consist of a single light source 162 positioned on first printed circuit board 160 such that first group 190 is generally centered within inner ring 167. However, if light guide 164 has a different shape or configuration than as shown in the exemplary embodiment of FIGS. 5 and 6, an appropriate number of groups of light sources 162 may be used, and light sources 162 may be arranged on first printed circuit board 160 other than in a ring or in a centered configuration as shown in FIG. 6. Thus, any other appropriate configuration of light guides 164 and light sources 162 may be used.

In the exemplary embodiment of FIG. 6, second printed circuit board defines two semicircular apertures 172, with a button portion 174 and connection portions 176 between the two apertures 172; in other embodiments, apertures 172 may have other shapes. As discussed, second printed circuit board 170 may include capacitive touch sensing system 171, whereby cooktop 100 is controlled at least in part through touch inputs on user interface 130 by a user of cooktop 100. For example, a user may touch a capacitive touch input component 132, and the touch input may be sensed by capacitive touch sensing system 171 of second printed circuit board 170 to activate, deactivate, or control one or more features, functions, or the like of cooktop appliance 100. As shown in FIG. 1, selection portion 131 may be or may include a capacitive touch input component 132. A touch input component 132 may correspond to button portion 174 and/or connection portions 176 of second printed circuit board 170 such that a touch input to selection portion 131 adjacent button portion 174 and/or connection portions 176 activates, deactivates, or controls one or more features, functions, or the like of cooktop 100.

More particularly, capacitive touch sensing system 171 of second printed circuit board 170 may be in operative communication with each heating assembly 120 to activate and deactivate heating elements 122, 124, 126 to vary the size and/or power density of each cooking zone 118. As an example, for a cooking zone 118 having a heating assembly 120 with three heating elements 122, 124, 126, each heating element 122, 124, 126 may be activated when the cooking zone 118 is powered on or activated by, e.g., a user input to user interface 130, such as a power button for the cooking zone 118. After the cooking zone 118 is activated such that all heating elements are activated, a touch input to selection portion 131 adjacent button portion 174 may deactivate third heating element 126, such that heating elements 122, 124 remain activated. A second touch input may deactivate second heating element 124, such that first heating element 122 remains activated, and in some embodiments, a third touch input may reactivate second and third heating elements 124, 126 such that each of heating elements 122, 124, 126 are again active. Subsequent touch inputs to selection portion 131 may continue the cycle through the sequence, e.g., a touch input may deactivate third heating element 126, another touch input may deactivate second heating element 124, and another touch input may reactivate heating elements 124, 126 such that all heating elements are active.

In alternative embodiments, a third touch input may reactivate second heating element 124 such that heating elements 122 and 124 are active, and a fourth touch input may reactivate third heating element 126 such that each heating element 122, 124, 126 is again active. Subsequent touch inputs to selection portion 131 may continue to cycle through the sequence, e.g., a touch input may deactivate third heating element 126, another touch input may deactivate second heating element 124, another touch input may reactivate second heating element 124, and yet another touch input may reactivate third heating element 126. All heating elements may be deactivated when cooking zone 118 is powered off or deactivated by, e.g., a user input to user interface 130, such as the power button described above.

Other sequences also may be used, e.g., double tapping selection portion 131 adjacent button portion 174 (i.e., two touch inputs adjacent button portion 174 in rapid succession) may activate or deactivate all heating elements simultaneously. Additionally, it will be readily understood that the sequence used may depend on the configuration of cooking zone 118 and heating assembly 120, e.g., if heating assembly 120 includes two or more than three heating elements. Further, touch inputs to selection portion 131 adjacent connection portions 176 also may be used to activate and deactivate the heating elements.

As further shown in FIG. 6, light guide 164 and light sources 162 positioned behind or below second printed circuit board 170 are configured to display up to three nested geometric shapes, e.g., partial rings, in selection portion 131. That is, using light guide 164 and light sources 162, an illuminated graphic 138 with multiple images may be displayed within selection portion 131 of user interface 130. A light transmissive layer 140 may be positioned between panel 110 and light sources 162 to provide essentially uniform illumination of graphic 138, i.e., light transmissive layer 140 diffuses the light from light sources 162 to eliminate bright or "hot" spots in graphic 138 at the location of individual light sources 162.

In the illustrated exemplary embodiment, graphic 138 illustrates a cooking zone 118 of cooktop appliance 100 such that the graphic may convey to the user which size, heating element, or power density of cooking zone 118 has been selected or activated. Further, as shown, graphic 138 essentially surrounds the segment of selection portion 131 adjacent button portion 174 and connection portions 176 such that graphic 138 is co-located with the touch-sensitive control area. Capacitive touch sensing system 171 of second printed circuit board 170 may be in operative communication with first, second, and third groups 190, 192, 194 of light sources 162 such that a touch input to selection portion 131 to activate or deactivate one or more heating elements of heating assembly 120 also activates or deactivates the group or groups of light sources to display an image illustrating the corresponding heating element or size and/or power density of cooking zone 118 and thereby displays graphic 138 within selection portion 131. Accordingly, a touch input to selection portion 131 may be sensed by capacitive touch sensing system 171 to activate or deactivate one or more features of cooktop appliance 100.

Figure 7C:
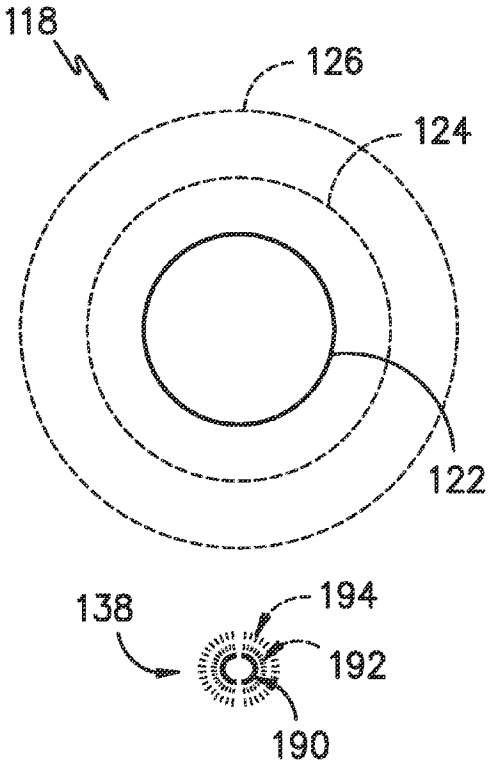
FIGS. 7A through 7C provide schematic views of a cooking zone and a selection portion of a user interface according to an exemplary embodiment of the present subject matter.
Figure 7B:
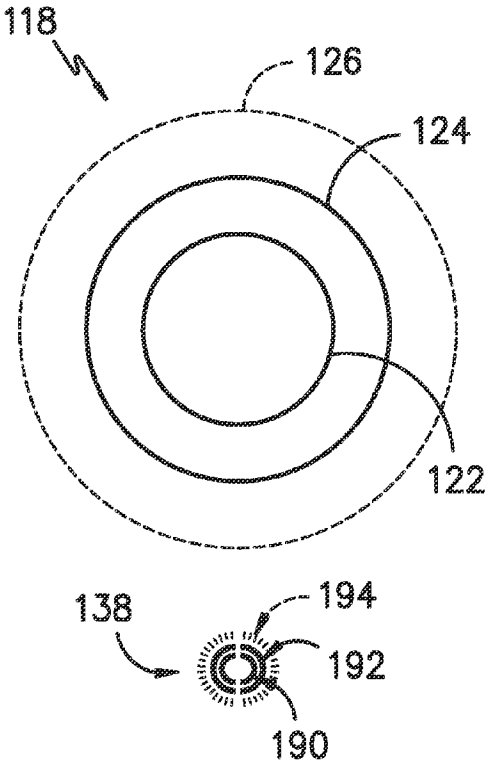
Figure 7A:
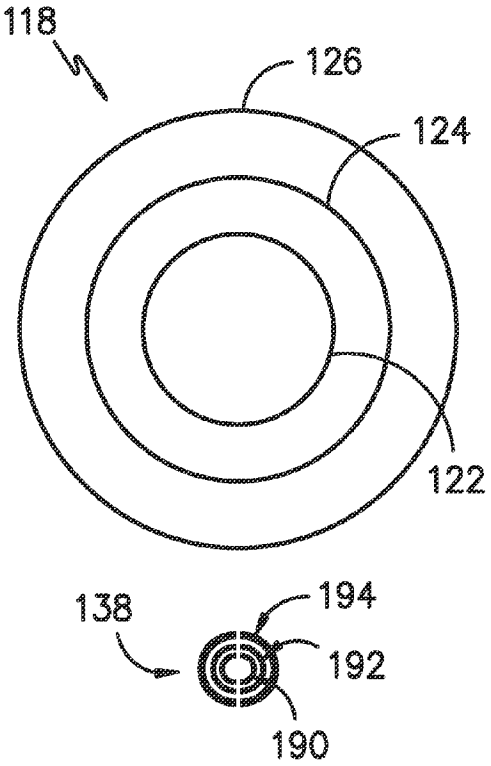

As shown in FIG. 7A, for example, when a cooking zone 118 is powered on or activated as previously described, each heating element of the associated heating assembly 120 and each group of light sources 162 may be activated. More particularly, first, second, and third groups of light sources 190, 192, 194 may be activated to provide light to selection portion 131 through passages 166 of light guide 164. As shown in, e.g., FIG. 6, when second printed circuit board 170 defines button portion 174 having connection portions 176 extending therefrom, illuminated graphic 138 comprises an image that is concentric partial ring shapes. Such graphic may indicate that a center heating element, an intermediate heating element, and an outer heating element such as first, second, and third heating elements 122, 124, 126 are activated, that a large size cooking zone 118 is active, or that cooking zone 118 is activated at its highest power density.

As shown in FIG. 7B, a touch input to selection portion 131 can deactivate third heating element 126 and third group 194 of light sources such that first group 190 and second group 192 are activated and graphic 138 displayed on selection portion 131 is an image of two concentric partial ring shapes. Such graphic may indicate that both a center heating element and an intermediate heating element, such as first and second heating elements 122, 124, are activated, that a medium or moderate size cooking zone 118 is active, or that cooking zone 118 is activated at a medium or moderate power density.

Referring now to FIG. 7C, a second touch input to selection portion 131 can deactivate second heating element 124 and second group 192 of light sources such that first group 190 is activated and graphic 138 displayed on selection portion 131 is an image of a partial ring shape. Such graphic may indicate that a center heating element, such as first heating element 122 is activated, that the smallest size cooking zone 118 is active, or that cooking zone 118 is activated at its lowest power density.

As previously described, in some embodiments, a third touch input to selection portion 131 may reactivate both second and third heating elements 124, 126 and, correspondingly, both second and third groups 192, 194 of light sources 162 such that graphic 138 resumes the image shown in FIG. 7A and subsequent touch inputs to selection portion 131 continue the cycle through deactivating and activating heating elements and groups of light sources. In other embodiments, a third touch input to selection portion 131 may reactivate second heating element 124 and second group 192 of light sources 162 such that graphic 138 resumes the image shown in FIG. 7B. In such embodiments, a fourth touch input to selection portion 131 may reactivate third heating element 126 and third group 194 of light sources 162 such that graphic 138 resumes the image shown in FIG. 7A, and subsequent touch inputs to selection portion 131 continue the cycle through deactivating and reactivating heating elements and groups of light sources.

Other configurations of graphic 138 may be used as well, and the shape and/or size of the images of graphic 138 may be defined in whole or in part by light guide 164, apertures 172, and/or masking material 152 of light transmissive layer 140. Moreover, as shown in FIGS. 2 and 3, light guides 164 and apertures 172 may be configured to provide a graphic 138 for each cooking zone 118 of cooking appliance 100, but for cooking zones 118 that do not have multiple operating states, masking material 152 may be used on, e.g., light transmissive layer 140 to mask graphic 138 such that it does not appear on user interface 130 in association with such cooking zones. In addition or alternatively, other sequences to activate and/or deactivate light sources 162 also may be used, as described above with respect to activating and deactivating the heating elements.

Although described above as utilizing two printed circuit boards 160, 170, in an alternative exemplary embodiment, the elements of the two circuit boards may be combined such that only one printed circuit board is required. For example, user interface assembly 136 may include user interface 130 and first printed circuit board 160 positioned below user interface 130 along the vertical direction V. In this exemplary embodiment, first printed circuit board includes capacitive touch sensing system 171 as described above with respect to second printed circuit board 170. Light sources 162 may be positioned on first printed circuit board 160 such that the light from light sources 162 is directed away from cooking panel 110 and user interface 130. Further, light guide 164 may include a plurality of reflector boxes and may be held in place against the bottom surface of first printed circuit board 160 with a layer of adhesive 141, 142. The plurality of reflector boxes of light guide 164 guide from light sources 162 toward user interface 130 by redirecting the light, i.e., the light from light sources 162 is reflected off an interior surface of the reflector boxes and thereby directed toward user interface 130 through apertures defined by printed circuit board 160. Additionally, light transmissive layer 140 may be disposed between user interface 130 and first printed circuit board 160 and may be held in place by one or more layers of adhesive 141, 142 as described above. First printed circuit board 160, light guide 164, light sources 162, and/or light transmissive layer 140 may be configured as previously described to display graphic 138 within selection portion 131 such that graphic 138 is co-located with a touch input component 132, and a user may select one or more operating states of cooktop appliance 100 within the area displaying a graphic indicating the operating state of appliance 100.

Accordingly, cooktop appliance 100 may include a feature such as, e.g., cooking zones 118, having multiple operating states, and selection portion 131 having graphic 138 allows a user to select a desired operating state and displays the selected operating state to the user within the co-located selection area. It should be easily understood by those having ordinary skill in the art that selection portion 131 and graphic 138 may be provided for other features of cooktop appliance 100 and that user interface 130, having selection portion 131 and graphic 138 as described herein, may be provided for any suitable appliance.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A user interface assembly for an appliance, comprising:
- a panel including a user interface and a selection portion within the user interface;
- a first printed circuit board spaced apart from the panel, the first printed circuit board comprising a plurality of light sources;
- a second printed circuit board disposed between the panel and the first printed circuit board, the second printed circuit board comprising
  - one or more apertures for the passage of light therethrough,
  - a capacitive touch sensing system for sensing touch inputs by a user of the user interface assembly, and
  - a button portion adjacent the selection portion of the panel; and
- a light guide positioned between the first printed circuit board and the second printed circuit board adjacent the selection portion, the light guide surrounding one or more light sources such that the light guide directs substantially all light from the one or more light sources to the user interface in order to display a graphic with multiple images within the selection portion.

2. The user interface assembly of claim 1, wherein the graphic is co-located with a touch input component.

3. The user interface assembly of claim 1, wherein the appliance has a feature with multiple operating states that may be selected by a touch input to the selection portion, and wherein the graphic indicates a selected operating state of the feature.

4. The user interface assembly of claim 1, wherein the graphic is defined at least in part by the light guide.

5. The user interface assembly of claim 1, wherein the graphic comprises nested geometric shapes.

6. The user interface assembly of claim 5, wherein each geometric shape is a ring.

7. The user interface of claim 1, further comprising a light transmissive layer disposed between the panel and the light source to provide essentially uniform illumination of the graphic.

8. The user interface assembly of claim 1, wherein the light guide comprises at least two concentric rings.

9. The user interface assembly of claim 1, wherein the appliance is a cooktop appliance comprising a cooking zone having a variable size, and wherein a touch input to a touch input component associated with the cooking zone allows the user to select a cooking zone size and the graphic is co-located with the touch input component to indicate the selected size of the cooking zone.

10. A cooktop appliance, comprising:
- a cooking panel comprising a cooking zone;
- a plurality of heating elements positioned adjacent the cooking zone for heating a cooking utensil disposed on the cooking zone; and
- a user interface assembly comprising
  - a user interface defined on the cooking panel, the user interface including a selection portion configured to display a graphic;
  - a first printed circuit board spaced apart from the cooking panel, the first printed circuit board comprising a plurality of light sources;
  - a second printed circuit board disposed between the cooking panel and the first printed circuit board, the second printed circuit board comprising one or more apertures for the passage of light therethrough, at least one aperture defined adjacent the selection portion, a capacitive touch sensing system for sensing touch inputs by a user of the user interface, the capacitive touch sensing system in operative communication with the heating elements and the light sources, and a button portion adjacent the selection portion of the cooking panel; and a light guide positioned between the first printed circuit board and the second printed circuit board adjacent the selection portion, the light guide surrounding one or more light sources such that the light guide directs substantially all light from the light source to the user interface in order to display a graphic with multiple images within the selection portion.

11. The cooktop appliance of claim 10, wherein repetitive touch inputs to the selection portion cycles between operational states of the cooktop appliance in a predefined sequence.

12. The cooktop appliance of claim 10, wherein the cooking zone has a variable size, and wherein a touch input to the selection portion selects a size of the cooking zone and activates a group of the light sources to display the graphic with the image indicating the selected size.

13. The cooktop appliance of claim 10, wherein the cooking zone has a variable power density, and wherein a touch input to the selection portion selects a power density of the cooking zone and activates a group of the light sources to display the graphic with the image indicating the selected power density.

14. The cooktop appliance of claim 10, wherein the graphic comprises nested geometric shapes.

15. The cooktop appliance of claim 14, wherein each geometric shape is a ring.

16. The cooktop appliance of claim 10, wherein the graphic is defined at least in part by the light guide.

17. The cooktop appliance of claim 10, wherein the light guide comprises at least two concentric rings surrounding a center portion.

18. A user interface assembly for an appliance, comprising:

a panel including a user interface and a selection portion within the user interface;

a first printed circuit board spaced apart from the panel, the first printed circuit board comprising a plurality of light sources;

a second printed circuit board disposed between the panel and the first printed circuit board, the second printed circuit board comprising one or more apertures for the passage of light therethrough, and a capacitive touch sensing system for sensing touch inputs by a user of the user interface assembly; and a light guide positioned between the first printed circuit board and the second printed circuit board adjacent the selection portion, the light guide comprising an outer ring, an intermediate ring, and an inner ring that are concentric with one another, wherein the intermediate ring is spaced apart from the outer ring to delineate a generally ring-shaped passage to guide light from the light sources to the selection portion, wherein the inner ring is spaced apart from the intermediate ring to delineate a generally ring-shaped passage to guide light from the light sources to the selection portion, and wherein the light guided by the light guide forms a graphic with multiple partial ring-shaped images within the selection portion.

* * * * *